US008968812B2

(12) United States Patent
Ehrlinger

(10) Patent No.: US 8,968,812 B2
(45) Date of Patent: Mar. 3, 2015

(54) METHOD FOR PRODUCING A MIXED PRODUCT

(75) Inventor: Klaus Ehrlinger, Fröndenberg (DE)

(73) Assignee: KHS GmbH, Dortmund (DE)

( * ) Notice: Subject to any disclaimer, the term of this patent is extended or adjusted under 35 U.S.C. 154(b) by 333 days.

(21) Appl. No.: 13/496,908

(22) PCT Filed: Sep. 7, 2010

(86) PCT No.: PCT/EP2010/005477

§ 371 (c)(1),
(2), (4) Date: Mar. 19, 2012

(87) PCT Pub. No.: WO2011/063867

PCT Pub. Date: Jun. 3, 2011

(65) Prior Publication Data

US 2012/0174796 A1 Jul. 12, 2012

(30) Foreign Application Priority Data

Nov. 24, 2009 (DE) ..... 10 2009 054 313

(51) Int. Cl.

| | |
|---|---|
| ***A23L 2/54*** | (2006.01) |
| ***B01F 3/04*** | (2006.01) |
| ***B01F 3/20*** | (2006.01) |
| ***B01F 15/00*** | (2006.01) |

(52) U.S. Cl.

CPC ..... *B01F 3/04815* (2013.01); *B01F 3/04468* (2013.01); *B01F 3/0473* (2013.01); *B01F 3/04751* (2013.01); *B01F 3/04808* (2013.01); *B01F 3/20* (2013.01); *B01F 3/2021* (2013.01); *B01F 15/00253* (2013.01); *B01F 15/00285* (2013.01); *B01F 15/0035* (2013.01); *B01F 2003/049* (2013.01)

USPC ..... 426/477; 426/474; 426/519; 141/9; 141/198

(58) Field of Classification Search

USPC ..... 99/323.2; 366/152.1, 152.2, 153.1, 131, 366/132, 134; 426/474, 477, 519; 141/9, 141/198

See application file for complete search history.

(56) References Cited

U.S. PATENT DOCUMENTS

| | | | | | |
|---|---|---|---|---|---|
| 1,373,817 | A * | 4/1921 | Humphrey | 426/477 |
| 2,698,701 | A * | 1/1955 | Kraft | 222/133 |
| 2,747,782 | A * | 5/1956 | Booth | 141/107 |
| 4,076,145 | A * | 2/1978 | Zygiel | 222/1 |
| 5,564,601 | A * | 10/1996 | Cleland et al. | 222/129.1 |
| 5,624,182 | A * | 4/1997 | Dearing et al. | 366/2 |
| 6,374,845 | B1 * | 4/2002 | Melendez et al. | 137/3 |
| 7,250,464 | B2 * | 7/2007 | Friel et al. | 524/497 |
| 2009/0236007 | A1 * | 9/2009 | Clusserath et al. | 141/9 |

FOREIGN PATENT DOCUMENTS

| | | |
|---|---|---|
| DE | 1213212 | 3/1966 |
| DE | 9115831 | 3/1992 |
| GB | 2404371 | 2/2005 |
| WO | 98/07122 | 2/1998 |
| WO | 2010/017280 | 2/2010 |

* cited by examiner

*Primary Examiner* — Anthony Weier
(74) *Attorney, Agent, or Firm* — Occhiuti & Rohlicek LLP

(57) ABSTRACT

The invention relates to a method for producing a liquid mixed product from at least one liquid base component and at least one liquid additive, which is added to the base component in a metered manner, wherein the at least one liquid additive is metered into the base component depending on the amount of the mixed product removed from the mixing chamber (2.3).

8 Claims, 1 Drawing Sheet

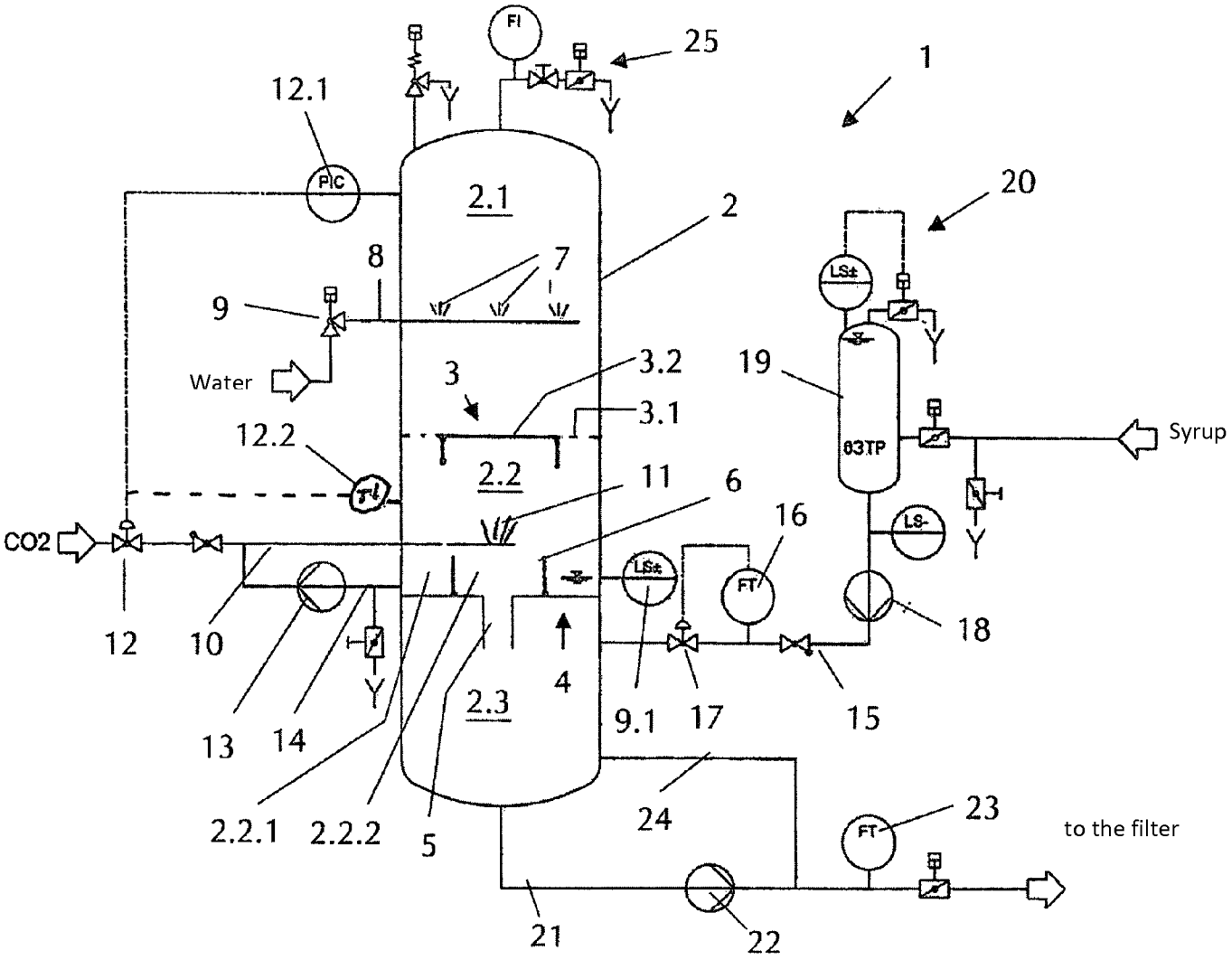
Syrup
to the filter
Water
CO2
1
2
2.1
2.2
2.2.1
2.2.2
2.3
3
3.1
3.2
4
5
6
7
8
9
9.1
10
11
12
12.1
12.2
13
14
15
16
17
18
19
20
21
22
23
24
25
FI
PIC
FT
LS
LSL
LSH
63TP

METHOD FOR PRODUCING A MIXED PRODUCT

CROSS REFERENCE TO RELATED APPLICATIONS

This application is the national stage of international application no. PCT/EP2010/005477, filed on Sep. 7, 2010, which claims the benefit of the Nov. 24, 2009 priority date of German application no. 10 2009 054 313.9. The contents of the prior applications are incorporated herein.

FIELD OF INVENTION

This disclosure relates to a method and apparatus for producing mixed products, such as mixed beverages, having a liquid base component and at least one additive added to the base component in a metered manner, the additive being a liquid additive and/or a gaseous additive, such as $CO_2$ gas.

BACKGROUND

Generally, when producing mixed beverages, it is necessary to first degas the liquid's base component, which is often water, and to then mix it with at least one additive, such as a flavoring or a syrup, to a required end concentration. If the mixed beverage is a carbonated beverage, it will also be necessary to carbonate and buffer the mixed beverage with $CO_2$ gas until it has been filled into containers or bottles. Such mixed products are processed in mixing systems, often called mixers, consisting of several components.

Two known ways to degas a base component are vacuum degassing, and pressure degassing. Both kinds of degassing can be single-stage or multi-stage. During vacuum degassing, the partial pressure drop that releases dissolved gases from the base component is achieved by vacuum or pressure drop. During pressure degassing, the release of the dissolved foreign gases from the particular base component is achieved by diffusion in a carrier gas free from oxygen and/or nitrogen, e.g. $CO_2$ gas.

The mixing of the base component with the at least one additive (for example syrup) into the finished or mixed product is currently performed via ratio control, i.e. by controlling the volume flows of the base component and of the additive so that they maintain respective set points. Both set points are put into a ratio according to the preselected or desired formulation. To achieve the required dosing accuracies, continuous control of the volume flows, in particular continuous volume flows through the particular mixing chamber, will be required.

The carbonation or dosing of the $CO_2$ gas, for known methods and mixing systems, will also be performed via ratio dosing or via spray carbonation. In the latter case, the mixed product is sprayed into a container that has been pressurized with $CO_2$ gas. The gas pressure is set according to the saturation pressure, which depends on, among other things, the dosing rate and the temperature. The $CO_2$ gas dissolves in the mixed product until a balance is achieved between the pressure of the $CO_2$ gas in the atmosphere and the partial pressure or saturation pressure of $CO_2$ gas in the carbonated mixed beverage.

A filler usually fills a container or bottle with the carbonated mixed product or mixed beverage produced with the mixing system. Like the mixing system, the filler is a component part of one complete filling line.

In known systems, continuous operation is required to assure accuracy in dosing, mixing, and carbonation. Unfortunately, disruptions in continuous operation are almost inevitable. These disruptions include disruptions in the environment, in the system, and in the packaging material, for example disruptions arising from bottle breakage etc. As a result, stops or reduced output will often occur.

To accommodate these interruptions, known systems require a large volume buffer or buffer tank for uncoupling or buffering between mixing system and filler. Practical buffer tanks have relatively large volumes, for example up to 1000 liters. Usually, such buffer tanks are operated with a heavily fluctuating fill level. This means that the mixed product in the buffer tank must be overlaid with a $CO_2$ gas cushion whose pressure is higher than the $CO_2$ saturation pressure in the mixed product. In case of changing fill levels, it will be necessary to replenish the buffer tank with $CO_2$ gas or to drain it. This leads to high consumption of $CO_2$ gas.

A device and a method for producing mixed products were introduced by DE 1 213 212. Consequently, this publication provides for the base component, for example water, and the additive, for example syrup, to be simultaneously fed to a dosing unit, wherein the components enter a mixing vessel at a preset, accurately measured quantity ratio. The disadvantage of this procedure is that known dosing units for the simultaneous feeding of several components are complex and expensive and, moreover, usually only have limited accuracy.

SUMMARY

The invention provides a method and system for producing mixed products from at least one base component and from at least one additive that maintaining a high dosing accuracy, and that can be performed with less complex control and/or fewer machinery requirements.

The at least one basic or base component is a liquid component. The at least one additive is a liquid and/or a gaseous component and, in the latter case, $CO_2$ gas.

The metered addition of the at least one preferably liquid additive to the at least one liquid base component in the mixing chamber is achieved in the manner that the adding or dosing of the at least one additive is controlled or regulated depending on the quantity of the mixed product which (the quantity) is removed from the mixing chamber. This, preferably, then provides means for a level- or volume-controlled feeding or refilling of the at least one base component into the mixing chamber such that, by feeding or refilling of the at least one base component, the total volume formed in the mixing chamber by the at least one base component and the at least one additive is constant.

The metered addition of the at least one additive in the mixing chamber can be performed continuously, or intermittently or batch-wise. Preferably, the mixing chamber simultaneously forms the buffer from which the mixed product is fed to the filler which follows the overall systems. As the mixing does not require continuous operation, the mixing chamber and, thus, also the buffer or buffer tank formed by this mixing chamber can be implemented with a reduced volume, for example with a volume of only 100 liters at a nominal capacity of the device or mixing system of 30 m3/h. Through the reduced volume of the mixing chamber alone, which also serves as a buffer tank, there is a substantial reduction in the size of the mixing system or device for producing mixed products according to the invention.

According to a further aspect underlying the invention, at least two functions of conventional mixing systems are combined in a common functional container, for example the functions of degassing and subsequent carbonation of the at least one base component. The functional container or a functional space created within it then serves, preferably, also as a mixing chamber and preferably as a combined mixing chamber and buffer tank.

The level-controlled or volume-controlled feeding of the at least one base component into the mixing chamber, in the simplest case, is achieved by the mixing chamber having, on at least one mixing chamber inlet for the at least one base component, a level-determining element, for example in the form of an overflow, and by means being provided for constantly overflowing the mixing chamber inlet during the operation of the mixing system or device with the at least one base component.

In one aspect, the invention features a method for producing a liquid mixed product from at least one liquid base component and at least one additive that is added to the liquid base component in a metered manner. Such a method include, in operation, maintaining a continuous supply of the liquid mixed product by detecting removal of a quantity of liquid mixed product from a mixing chamber, and adding the at least one additive to the at least one liquid base component to an extent that depends on the detected quantity of the liquid mixed product removed from a mixing chamber.

Some practices further include delivering the at least one liquid base component to the mixing chamber in at least one of a volume controlled manner and a level controlled manner such that, during operation, a volume occupied by the at least one liquid base component and the at least one additive in the mixing chamber remains constant.

Some practices include delivering the at least one liquid base component to the mixing chamber in at least one of a volume controlled manner and a level controlled manner such that a quantity of the at least one liquid base component refilled into the mixing chamber equals a proportion of the at least one liquid base component removed from the mixing chamber. Among these practices are those in which delivering the at least one liquid base component includes refilling the at least one liquid base component via a mixing chamber inlet of the mixing chamber, wherein the mixing chamber includes an overflow.

Practices of the invention include those in which one adds the at least one additive to the at least one liquid base component includes adding the at least one additive continuously, and those in which one adds the at least one additive to the at least one liquid base component includes adding the at least one additive in batches.

Other practices include filling containers with the liquid mixed product directly without storage in an intermediate buffer tank.

Yet other practices include applying a carbon dioxide gas cushion to the liquid mixed product, the cushion having a pressure lower than a carbon dioxide saturation pressure in the liquid mixed product.

Further developments, advantages and possible applications of the invention also follow from the description below of typical examples and from the figures. Basically, all features described and/or depicted, for themselves or in any combination, are the subject matter of the invention, irrespective of their summary in the claims or their retrospectivity. The content of the claims is also made a part of the description.

BRIEF DESCRIPTION OF THE FIGURES

Hereinafter, the invention is clarified using FIG. 1 which, in a schematic functional representation, shows a mixing system according to the invention.

DETAILED DESCRIPTION

Referring to FIG. 1, a mixing device 1 produces a carbonated liquid mixed product, i.e. with carbonic acid or $CO_2$ gas added. This product is preferably a mixed beverage. The device 1 does so by mixing one liquid main or base component with at least one liquid additive. In some embodiments, the liquid main or base component is water. The liquid additive is typically a flavoring additive, such as syrup.

In the illustrated device 1, all functions and components usually featured in a mixing system are combined in the single functional container 2. These functions include the degassing or liberation of the base component from unwanted foreign gas components dissolved therein, the metered addition of $CO_2$ gas to the base component, for example with a quantity corresponding to the $CO_2$ saturation pressure of the mixed product, and the metered feeding of the additive. In addition, the container 2 functions as a buffer.

A first horizontal partition 3 and a second horizontal partition 4 divide the internal space of the functional container 2 into a top functional space 2.1, a middle functional space 2.2, and a bottom functional space 2.3. In the direction of the vertical axis of the functional container 2, these functional spaces connect to each other.

The top functional space 2.1 is used for pressure degassing and for the at least partial carbonation of the base component. The bottom functional space 2.3 is simultaneously used as a mixing chamber for the mixing of the base component with the additive and as a buffer. The middle functional space 2.2 is used for the complete carbonation of the base component to the $CO_2$ deconcentration as well as for controlled feeding of the base component into the bottom functional space 2.3.

In the embodiment shown, the second partition 4 has a central passage 5 that connects the middle functional space 2.2 and the bottom functional space 2.3. The central passage 5 is implemented as an immersion tube that reaches into the bottom functional space 2.3. In the area of the middle functional space 2.2, the central passage 5 is enclosed by an ring-shaped overflow barrier 6 so that, on the underside of the middle functional space 2.2, i.e. at the second partition 4, two separate areas are formed: an outer ring-shaped separate area 2.2.1, and an inner separate area 2.2.2. The outer ring-shaped separate area 2.2.1 is between the inner surface of the wall of the functional container 2 and the overflow barrier 6. The inner separate area 2.2.2 connects, via the passage 5, to the bottom functional space 2.3.

Several nozzles 7 are arranged in the top functional space 2.1 at a distance from both the first partition 3 and at a distance from the top of the functional container 2. These nozzles 7 connect, via a line 8 with a control valve 9, to a source (not shown) for providing the liquid base component.

The nozzles 7 are arranged and designed such that, when control valve 9 opens, a fine spray of the base component emerges from the nozzles 7 upward in a vertical direction and then falls back onto the first partition 3. The first partition 3 is, in the embodiment shown, in a boundary area 3.1 near the wall of the functional container 2. This boundary area 3.1 has a perforated plate or perforated floor with a plurality of openings and, in its central area 3.2 has a closed wall or a closed floor.

A line 10 goes into the middle functional space 2.2. Within the middle functional space 2.2, the line 10 is provided with at least one nozzle 11 located at a distance above the overflow barrier 6 and above the inner separate area 2.2.2 as well as at a distance below the central area 3.2 of the first partition 3, which is designed as a baffle. The nozzle 11 is designed and arranged such that the nozzle jet exits vertically upward from this nozzle, i.e. aimed at the central area 3.2. As a result, the central area 3.2 serves as a rebound wall.

The line 10 is connected, via a control valve 12, with a source (not shown) that provides the $CO_2$ gas under pressure. The control valve 12 is controlled such that the gas pressure within the functional container 2 and, in particular, within the top functional space 2.1 and the middle functional space 2.2, corresponds to the $CO_2$ concentration in the produced mixed product, also taking into account, for example, further parameters such as the temperature of the mixed product, dosing or formulation of the mixed product etc.

Pressure sensors 12.1 and/or temperature sensors 12.2 are provided at the top functional space 2.1 and the middle functional space 2.2. These sensors provide measuring signals. Using these measuring signals, the control valve 12 is controlled to adjust the $CO_2$ pressure in the functional container 2 to be high enough to achieve the desired $CO_2$ content in the mixed product, taking into account the fact that adding the $CO_2$-free syrup reduces the $CO_2$ content in the finished product.

The exit, or the pressure side, of a pump 13 is connected to the line 10, in the flow direction of the $CO_2$ gas, following the control valve 12. Its input is linked to the outer ring-shaped separate area 2.2.1 via a line 14.

For the metered addition of the additive, the bottom functional space 2.3, which serves as a mixing chamber and simultaneously as a buffer, is connected to a line 15 and a pump. A dosing valve 17 controlled by a suitable meter, such as a flow meter 16, lies along this line 10. The pump feeds the additive under pressure. In one example, the flow meter 16 is a magnetically inductive flow meter.

To simplify the dosing or the control of the dosing valve 17, it is preferred that a density measurement be integrated into the flow meter 16. This enables a dosing that is independent of temperature and/or pressure or at least largely independent of temperature and/or pressure.

However, the meter may also be a mass flow meter through which, on the volume flow cannot be measured directly, but through which the mass flow, the density, and also the temperature can be ascertained.

The input of a pump 18 is connected, via a bleed container 19 (bleed lantern), to an additive source, which is not shown. At the beginning of each production phase, the bleed container 19 is bled via a bleed valve arrangement 20 so that the container is then completely filled with the additive and thus, in particular, does not require a buffering of the additive in the bleed container 19 by a pressurized inert gas buffer, for example, a $CO_2$ gas buffer. This contributes substantially to reducing consumption of inert gas or $CO_2$.

On the floor of the bottom functional space 2.3, in which at least one mixing element (not shown) is provided, a product line 21 with pump 22 and flow meter 23 is connected. It is through this product line through which the device 1 is connects to a filling machine (not shown) for the filling of bottles or other containers with the mixed product.

A return line 24 is connected to the product line 21 between the output of the pump 22 and the flow meter 23. As a result, the pump 22 can be operated independently of each current quantity of the mixed product delivered to the filling machine and registered by the flow meter 23. The pump 22 can, for example, be operated with constant output. In one example, the flow meter 23 is a magnetically inductive flow meter designed for error-free registration of phases with stop/go operation and/or with a reduced output of the filler.

The operating principle of the device 1 can be described as follows:

Both degassing and at least partial carbonation occur simultaneously in the top functional space 2.1. Partial carbonation of the base component includes, for example, carbonation to 80-90% of the $CO_2$ deconcentration of the mixed product. Like the rest of the internal space of the functional container 2, the top functional space 2.1 is also pressurized with the required $CO_2$ gas pressure, which is controlled by the control valve 12. This facilitates such partial carbonation.

Nozzles 7 spray the base component upward in the direction of the ceiling or in the direction of the upper limit of the functional space 2. The base component then rains back onto the partition 3, which forms the floor of the top functional space 2.1. This is where a pressure degassing of the base component occurs by diffusion as well as simultaneously by the carbonation of the base component. This is because in the top functional space 2.1, $CO_2$ pressure equals saturation pressure.

By spraying the base component from the nozzles 7 upward and then having it rain back down, the height of the functional space is doubly used. This extends the dwelling time of the sprayed base component in the top functional space 2.1 and also enlarges of the effective exchange surface between the base component and the $CO_2$ gas in the top functional space 2.1. The foreign gas proportion in the base component after treatment is down to about 10% or less.

The degassed and carbonated base component backs up on the partition 3 and then passes through the openings in the partition section 3.1 into the middle functional space 2.2, that is into its outer ring-shaped separate area 2.2.1 arranged below the partition section 3.1. In this outer ring-shaped separate area 2.2.1, there is at least one fill level sensor 9.1 for controlling the control valve. The sensor 9.1 can be formed by a min/max probe. The sensor 9.1 provides measurements for use in controlling the liquid level in the outer ring-shaped separate area 2.2.1 such that the level of this liquid remains constantly well below the upper edge of the overflow barrier 6.

The pump 13, which preferably runs with constant output V13 during the operation of the device 1, constantly delivers base component from the outer ring-shaped separate area 2.2.1 via the line 10 to the nozzle 11 arranged over the separate area 2.2, i.e. the inner separate area 2.2.2. Thus, the inlet to the bottom functional space 2.3 is constantly overflowing with the base component.

Simultaneously, the base component in the line 10 is mixed with the $CO_2$ gas delivered via the control valve 12 in such a manner that the base component discharged from the at least one nozzle 11 upward into the middle functional space 2.2 and against the partition section 3.2 that serves as a rebound wall has a proportion of $CO_2$ that is well above the $CO_2$ saturation, for example a $CO_2$ concentration of 210% of the $CO_2$ saturation concentration.

After the exit of the base component from the at least one nozzle 11, excess $CO_2$ gas is released within the middle functional space 2.2. This $CO_2$ gas in the middle functional space 2.2, which is released or liberated through "flashing," counter-flows into the top functional space 2.1 through the partition section 3.1 formed as a perforated floor. Thus, the $CO_2$ gas flow, which is free from foreign gases, sparges the base component that goes through the partition section 3.1 and flows, in free downward fall, into the outer ring-shaped separate area 2.2.1. This leads to complete carbonation of the base component so that it then has the desired $CO_2$ deconcentration, for example in the form of a 100% $CO_2$ saturation. Furthermore, the $CO_2$ gas released in the middle functional space 2.2 through "flashing" and flowing through the partition section 3.1 also serves to pressurize the top functional space 2.1 with the required $CO_2$ gas pressure.

For this, the greater part of the $CO_2$ gas that has entered the top functional space 2.1 via the partition section 3.1 is used in the manner described above for the degassing and simultaneous carbonation of the base components discharged from the nozzles 7. A smaller proportion, for example 10% of this $CO_2$ gas, is drained via a valve arrangement provided at the top of the functional container 2 or of the top functional space 2.1 (which, in practice, is also called foreign gas sniffing 25), for discharging the spoil gases removed from the base component.

During the entire operation of the device 1, the bottom functional space 2.3 is always completely filled with the mixed product, such that the liquid queues from the bottom functional space 2.3 through the passage 5 into the inner separate area 2.2.2 up to the upper edge of the overflow barrier 6. The additive, controlled via the dosing valve 17, is delivered continuously, or intermittently or batch-wise, through the flow meter 16, depending on the quantity of the mixed product removed from the bottom functional space 2.3 and delivered to the filler via the product line 21, i.e. depending on the measuring signal of the flow meter 23 and depending on the required dosing of the additive in the mixed product.

If the formulation stays unchanged, the additive is thus dosed ultimately depending on the quantity of mixed product removed from the device 1 via the product line 21.

For this, the bottom functional space 2.3, which serves as a mixing chamber and buffer, is constantly filled with the base component, this being achieved by at least the greater part of the base component, which exits from the at least one nozzle 11, reaching the top of the inner separate area 2.2.2.

If the liquid level in the inner separate area 2.2.2 has sunk to below the level of the upper edge of the overflow barrier 6 and thus requires refilling of the bottom functional space 2.3 with the base component, the base component which entered the inner separate area 2.2.2 enters via the passage 5 into the bottom functional space 2.3.

If, however, the inner separate area 2.2.2 is completely filled with base component, the base component discharged from the nozzle 11 flows back via the edge of the overflow barrier 6 into the outer ring-shaped separate area 2.2.1. A direct mixing of the base component accommodated in the outer ring-shaped separate area 2.2.1 with the component in the separate area 2.2.2 or with the mixed product in the bottom functional space 2.3 is avoided through the partition 4 with the overflow barrier 6.

In the normal operational state, however, a part of the base component entering into the separate area 2.2.2 will enter through the passage 5 into the bottom functional space 2.3, whereby the other part of the base component from the separate area 2.2.2 will flow over into the outer ring-shaped separate area 2.2.1.

To enable this dosing of the additive alone through the control of the additive depending on the removed quantity of the finished mixed product, the pump 13 has an output V13 which is greater than the output V22 of the pump 22. Independent of the particular operational state of the pump 22, the output V13 of the pump 13 in any case is greater than the maximum output V22 of the pump 22. This ensures the continuous overflowing of the separate area 2.2.2 or of the overflow barrier 6 and also ensures that the bottom functional space 2.3 always has a constant fill level and the base component removed with the finished mix via the product line 21 is always replaced immediately.

Advantages of the device 1 according to the invention include its compact construction, the particularly straightforward control of the dosing of the at least one additive as well as, in particular, a reduced consumption of $CO_2$ gas. The entire mixing system, for example, is combined in a single functional container. The bottom functional space 2.3 forms both the mixing container and the buffer.

Through the type of control or regulation of the dosing according to the invention, a continuous volume flow is not required within the device 1 for the proper function of the mixing system, in contrast to the state of the art. As a result, and, in contrast to known mixing systems, a high-volume buffer tank is not required for ensuring the continuous operation of the mixing system even for a stop/go operation of the filling machine.

For a nominal capacity of the device 1 of 30 $m^3$/h, a volume of only 100 l is completely sufficient for the functional space 2.3, which also serves as a buffer. This contributes to a substantial reduction in the construction volume of the device 1, in particular taking into account the fact that known systems require buffers with much greater volume.

A further advantage of the invention also is that, through the described design and control of the device 1, the functional space 2.3, which serves as the mixing container and buffer, is constantly filled to the brim thus avoiding the need to provide an overlay of the mixed product in the functional space 2.3 with a $CO_2$ cushion. This reduces $CO_2$ losses and any unwanted re-carbonation. Furthermore, there is the possibility of re-dosing the mixed product accommodated in the functional space 2.3 through the additional introduction of at least one additive into this functional space, for example to compensate for faulty dosages such as those caused by a faulty concentration of the additive etc.

The invention was described above using a typical example. It is understood that numerous changes as well as modifications are possible without departing from the idea on which the invention is based.

For example, it is possible to integrate a quality measurement (Brix or $CO_2$ measurement) into the return line 24. It is further possible to perform the degassing and carbonation of the base component in more than one stage, for example also in the form that, in the common functional container 2, several functional spaces corresponding to the top functional space 2.1 are provided successively in a cascaded manner such that the base component degassed and at least partially carbonated in a first functional space is again degassed and re-carbonated in a further functional space etc. Furthermore, it also possible to perform at least the degassing and, if required, also the degassing and pre-carbonation of the base component, in an additional system.

Above, it was assumed that the degassing of the base component is performed by single-stage or multi-stage pressure degassing. However, for the device or mixing system according to the invention, vacuum degassing is also possible.

Above, it was further assumed that the base component only has one additive added. However, the mixing system or device according to the invention can also be designed for adding two or more than two, even different, additives to at least one base component, wherein, however, all versions preferably have in common that the dosing of the at least one liquid additive to the at least one base component is performed depending on the removed quantity of the mixed product. For this, in particular, there is the possibility of connecting the functional space 2.3 via the particular independent dosing valves with different sources for different additives or to provide a common dosing valve for several different additives, wherein the dosing valves, preferably, again are controlled depending on the quantity of the product removed from the device.

It is a vital advantage of the method according to the invention that the mixed product does not have to be intermediately stored, after its production, in a buffer tank since the application of the science according to the invention now makes it possible to continuously produce the mixed product even in varying quantities per time unit.

Another vital advantage of the method according to the invention is that now it is no longer necessary to apply a $CO_2$ gas cushion to the mixed product, after its production, whose pressure is higher than the $CO_2$ saturation pressure in the mixed product. This is due to the now-possible continuous production of the mixed product even in varying quantities per time unit, which does not require buffering in a buffer tank. Through this procedure according to the invention, the consumption of $CO_2$ gas is substantially reduced.

Having described the invention, and a preferred embodiment thereof, what is claimed as new, and secured by letters patent is:

The invention claimed is:

1. A method for producing a liquid mixed product from at least one liquid base component and at least one fluid additive that is added to said liquid base component in a metered manner, said method comprising, in operation, maintaining a continuous supply of said liquid mixed product by detecting removal of a quantity of liquid mixed product from a mixing chamber, and adding said at least one fluid additive to said at least one liquid base component to an extent that depends on said detected quantity of said liquid mixed product removed from a mixing chamber.

2. The method of claim 1, further comprising delivering said at least one liquid base component to said mixing chamber in at least one of a volume controlled manner and a level controlled manner such that, during operation, a volume occupied by said at least one liquid base component and said at least one additive in said mixing chamber remains constant.

3. The method of claim 1, further comprising delivering said at least one liquid base component to said mixing chamber in at least one of a volume controlled manner and a level controlled manner such that a quantity of said at least one liquid base component refilled into said mixing chamber equals a proportion of said at least one liquid base component removed from said mixing chamber.

4. The method of claim 3, wherein delivering said at least one liquid base component comprises refilling said at least one liquid base component via a mixing chamber inlet of said mixing chamber, wherein said mixing chamber includes an overflow.

5. The method of claim 1, wherein adding said at least one additive to said at least one liquid base component comprises adding said at least one additive continuously.

6. The method of claim 1, wherein adding said at least one additive to said at least one liquid base component comprises adding said at least one additive in batches.

7. The method of claim 1, further comprising filling containers with said liquid mixed product directly without storage in an intermediate buffer tank.

8. The method of claim 1, further comprising applying a carbon dioxide gas cushion to said liquid mixed product, said cushion having a pressure lower than a carbon dioxide saturation pressure in said liquid mixed product.

* * * * *